US007640974B1

(12) United States Patent
Hoeptner, III

(10) Patent No.: US 7,640,974 B1
(45) Date of Patent: Jan. 5, 2010

(54) SPOOL APPARATUS TO CONNECT TO UNDERGROUND WELL PIPE

(76) Inventor: Herbert W. Hoeptner, III, 7796 Oak Springs Cir., Gilroy, CA (US) 95020

( * ) Notice: Subject to any disclaimer, the term of this patent is extended or adjusted under 35 U.S.C. 154(b) by 171 days.

(21) Appl. No.: 11/114,617

(22) Filed: Apr. 27, 2005

(51) Int. Cl.
*E21B 33/00* (2006.01)

(52) U.S. Cl. ..... 166/85.2; 166/88.1; 166/50; 166/115; 285/123.4

(58) Field of Classification Search ..... 166/85.2, 166/88.1, 50, 115; 285/123.4
See application file for complete search history.

(56) References Cited

U.S. PATENT DOCUMENTS 1,539,236 A * 5/1925 Black ..... 277/329
3,270,818 A * 9/1966 Pugh, Jr. ..... 166/85.2
4,042,020 A * 8/1977 Wellstein ..... 166/85.2
4,056,144 A * 11/1977 Wellstein ..... 166/85.2
4,940,087 A * 7/1990 Lien et al. ..... 166/88.1
5,669,442 A * 9/1997 Gibson ..... 166/85.2
5,934,370 A * 8/1999 Hoeptner, III ..... 166/50
5,997,046 A * 12/1999 Hoeptner, III ..... 285/27

* cited by examiner

*Primary Examiner*—Jennifer H Gay
*Assistant Examiner*—Nicole A Coy
(74) *Attorney, Agent, or Firm*—William W. Haefliger

(57) ABSTRACT

Spool apparatus for use in an underground well having casing, comprising a body sized for travel in the well casing, the body defining a well fluid flow duct having a downward facing entrance and a sidewardly facing exit, there being a lower connection for coupling the body to lower well pipe to pass fluid into the body via the entrance, and an upper connection for coupling the body to upper carrier structure used for raising and lowering the body in the well casing, and there being means to latch connect the body to the well casing in a position for well fluid delivery from the body via the exit.

25 Claims, 3 Drawing Sheets

SPOOL APPARATUS TO CONNECT TO UNDERGROUND WELL PIPE

BACKGROUND OF THE INVENTION

This invention relates generally to apparatus for obtaining flow of water for underground wells, and more particularly to retrievable apparatus enabling pumping of water upwardly in a well and then laterally into underground pipes.

In the past, plastic pitless spools and housings have experienced difficulty when metal pipe was threaded into the spool or housing. Both male and female pipe threads are tapered so that when a metal pipe thread is secured into a plastic female pipe thread, and over tightened, the plastic will split. When the plastic spool splits, the entire drop pipe and pump would fall into the well. Also when the housing splits, the waterline would leak into the soil and then contaminate the well.

Manufacturers have tried unsuccessfully to "educate" the plumber to prevent them from over tightening the metal pipe. They have added fiberglass for strength to the plastic resin, molded metal rings into the plastic near the threads and even added an external banding around the outside of the plastic threaded area, all in an effort to prevent the plastic from splitting. The inability to correct this problem has forced manufacturers to withdraw their plastic pitless spools and housings from the market place.

There is need for simplifying improvements in apparatus referred to above, and particularly facilitating ease of retrieval of the underground pump, and without interference with sideward duct connection to lateral underground pipe which enables water delivery without freezing in winter. No apparatus of which I am aware embodies the improvements in construction, functioning and results, as are now provided by the present invention.

After much testing and research, it has been found that by placing a stop or shoulder at the base of the plastic threads it automatically prevents splitting of the plastic by limiting the travel of the metal pipe. A second solution to the problem is to mold the plastic threads as a male pipe thread. This forces a plumber to use a metal coupling before securing the metal pipe. The metal coupling, which has a female pipe thread, will have a clamping force on the molded plastic male pipe thread, thus preventing the plastic from splitting.

SUMMARY OF THE INVENTION

It is a major object of the invention to provide improved apparatus meeting the above needs. Basically, spool apparatus is provided for use in an underground well having casing, and comprises:

a) a body sized for travel in the well casing, b) said body defining a well fluid flow duct having a downward facing entrance and a sidewardly facing exit, c) there being a lower connection for coupling the body to lower well pipe to pass fluid into the body via said entrance, and an upper connection for coupling the body to upper carrier structure used for raising and lowering the body in the well casing, d) and there being means to latch connect the body to the well casing in a position for well fluid delivery from the body via said exit.

Another object is to provide latch means in the form of a snap ring to disconnect the body from the well casing in response to upward displacement of said carrier structure. A locking shoulder may be associated with the casing, to be engaged by a cam on the snap ring.

A further object is to provide an annular seal carried by the body to engage and seal off against a bore associated with the casing and at a level above said duct exit. In this regard, a second annular seal may be carried by the body to engage and seal off against a bore associated with the casing, and at a level below the duct exit. The casing may have a through port in registration with the flow duct exit. A transverse, underground flow defining pipe may be in registration with the through port to deliver water pumped upwardly in the well and into the body. A water pump may be carried by the lower well pipe to be retrieved upwardly from the well upon raising of the carrier structure and said body.

Yet another object is to provide the carrier structure in the form of upper well pipe attached to the ducted body, the locus of attachment normally being underground.

These and other objects and advantages of the invention, as well as the details of an illustrative embodiment, will be more fully understood from the following specification and drawings, in which:

DRAWING DESCRIPTION

DETAILED DESCRIPTION

Figure 1:
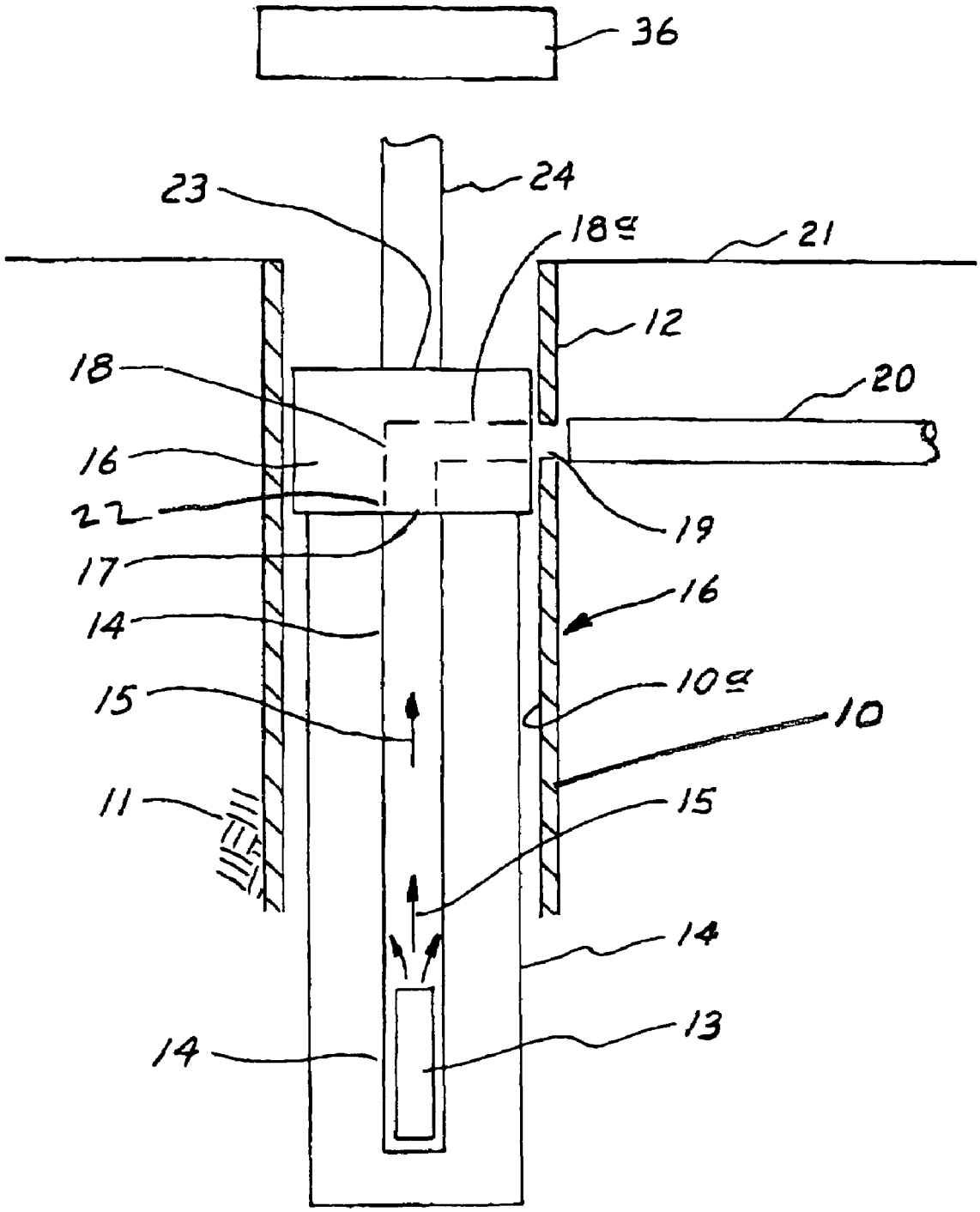
FIG. 1 is an elevation showing a water well and associated apparatus.

Referring first to FIG. 1, it shows a well 10 in the underground formation 11, with casing 12 installed in the well bore 10*a*. A pump 13 is installed in a lower well pipe 14 and operates to pump water in the well upwardly in pipe 14, as indicated by arrows 15. Such water flow enters a flow body 16 at lower entrance 17, to flow upwardly in a duct 18. Water then flows sidewardly in duct section 18*a*, leaving the body at exit 19. Water then passes to a transverse underground pipe 20 for delivery to a user or users. Such underground operations, including water flow, prevents freezing of water delivery during cold weather as in winter. Ground surface level is indicated at 21. A lower connector, as at 22 couples body 16 to lower well pipe 14; and an upper connector 23 couples the body 16 to upper carrier structure, such as including upper pipe 24 used for raising and lowering body 16 in the well.

Figure 2:
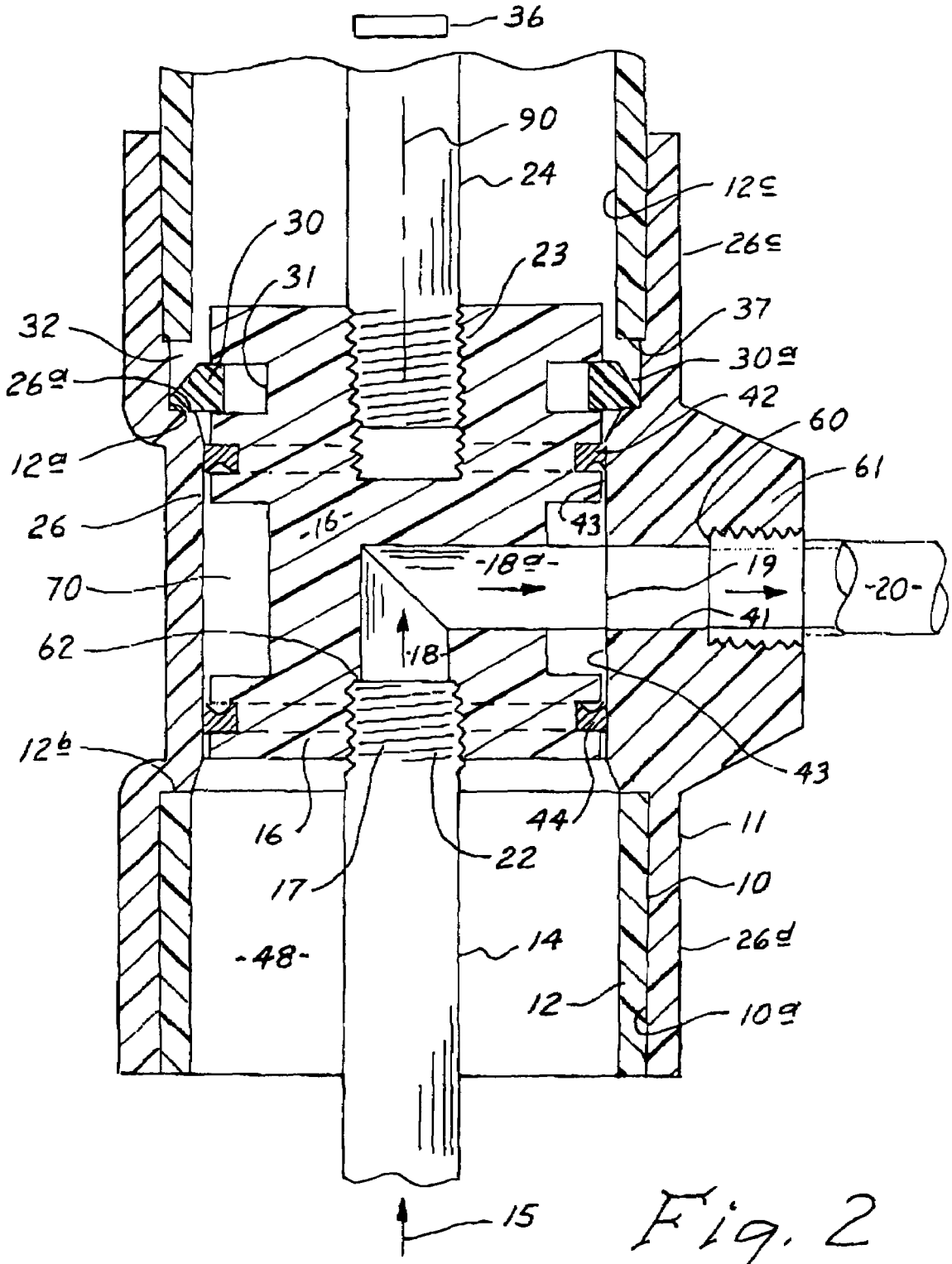
FIG. 2 is an enlarged section taken through FIG. 1 showing preferred apparatus incorporating the invention.

Extending the description to the preferred device of FIG. 2, an annular casing sub, or annular adapter 26, is provided for landing body 16 at a predetermined level upon its being lowered in the casing. Sub 26 may be carried by casing 12, as shown, i.e. as between casing shoulders 12*a* and 12*b*.

Means is provided for latch connecting the body to the well casing in a position, and at said operating level, for well fluid delivery from the body via duct 18*a* to exit 19. In the example, such means may preferably include a snap ring 30 carried by an annular groove 31 in body 16, the ring compressed radially by the casing bore 12*c*, as body 16 is lowered in the casing. When the body arrives in water delivery position or level, the snap ring self expands into an annular space or groove 32 defined by the sub 26, whereby the ring lands on upward facing surface 26*a* on 26. The body thereby becomes installed in position for water delivery to transverse pipe 20, via ducts 18 and 18*a* in body 16.

At such time as the body 16 and pump 13 are to be pulled from the well, the upper well pipe 24 is elevated, as by elevating means 36, causing tapered cam surface 30*a* on ring 30 to engage casing downward facing locking shoulder 37, acting to deflect the ring radially inwardly for travel lengthwise upwardly in the casing. Once the pump is pulled from the well, it can be repaired or replaced. Note that as the body is pulled upwardly, it travels past a through port 41 in the side of the casing, via which well water is delivered to pipe 20. Note annular recess 70.

An upper annular seal 42 is carried by the body 16 to engage and seal off against a casing sub bore 43, associated with the casing, at a level above the duct 18*a* exit and above the level of through port 41. This prevents water escape upwardly in the well above the body. A second annular seal 44 is carried by the body 16 to engage and seal off against a bore associated with the casing, as for example sub-bore 43, and at a level below the duct 18*a* exit 19 and the casing through port 41. This blocks pressurized water escape from duct exit 19 downwardly into the space 48 in the well bore, below body 16. It will be noted that duct exit 19 may extend annularly about the body vertical axis 90, so as to register with the casing through port 41 and the entrance to pipe 20, at any angle of the body about axis 90, upon installation.

A shoulder 60 in flange 61 stops the end of pipe 20 to prevent damage to the sub 26, which is typically plastic. That pipe end is typically threaded. Likewise, a shoulder 62 in body 16 stops the upper end of pipe 14.

Sub or housing 26 has tubular sections 26*c* and 26*d* to receive casing 11 and to form shoulders to seat 12*a* and 12*b*.

Figure 3:
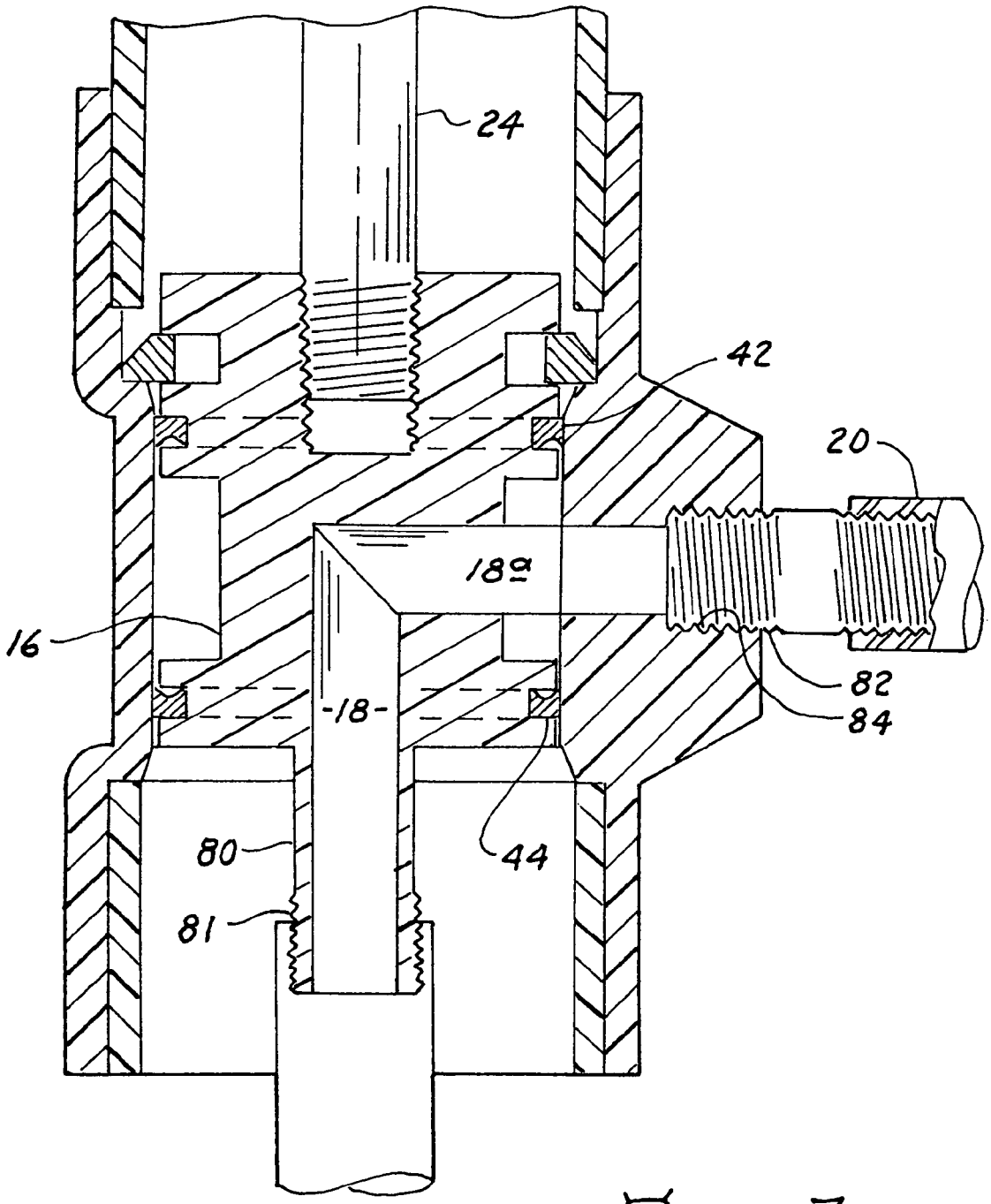
FIG. 3 shows a modification.

FIG. 3 is like FIG. 2, but shows a stem 80 protruding downwardly from plastic body 16, with threads at 81. A lower threaded pipe may be connected to 81. Also a threaded nipple 82 is carried by the end of pipe 20, to thread connect to 84.

I claim:

1. Spool apparatus for use in an underground well having casing, comprising a) a body sized for longitudinal travel in the well casing, b) said body defining a well fluid flow duct having a downward facing entrance and a sidewardly facing exit, c) there being a lower connection for coupling the body to lower well pipe to pass fluid into the body via said entrance, and an upper connection for coupling the body to upper carrier structure used for raising and lowering the body in the well casing, d) and there being means to latch connect the body to the well casing in a position for well fluid delivery from the body via said exit, e) and wherein said latch means includes a snap ring positioned to disconnect the body from the well casing in response to upward displacement of said carrier structure, the snap ring being expansible laterally in a body groove and into a position to land on an upward facing surface on a sub, the ring defining a cam surface engagable with a locking shoulder to deflect the ring radially for upward travel in the casing.

2. The combination of claim 1 wherein said carrier structure includes upper well pipe.

3. The combination of claim 1 including a locking shoulder associated with the casing, to be engaged by a cam on the snap ring.

4. The combination of claim 1 including an annular seal carried by the body to engage and seal off against a bore associated with the casing and at a level above said duct exit.

5. The combination of claim 4 including a second annular seal carried by the body to engage and seal off against a bore associated with the casing, and also level below said duct exit.

6. The combination of claim 5 including said casing having a through port in registration with the flow duct exit.

7. The combination of claim 6 including flow delivery pipe in registration with said port.

8. The combination of claim 6 including a water pump below said body to displace water upwardly in the wall to said body duct entrance.

9. The combination of claim 6 wherein the duct exit extends annularly about a vertical axis defined by the body.

10. The combination of claim 1 including said lower well pipe, and a water pump carried by said lower well pipe to be retrieved upwardly from the well upon raising of said carrier structure and said body.

11. The combination of claim 1 wherein said means includes a casing sub to which the lower well pipe is connected.

12. The combination of claim 1 wherein said lower connection includes a threaded tubular stem protruding downwardly from said body.

13. The combination of claim 1 wherein the body includes a port in registration with said exit, to receive the end of a sidewardly extending pipe.

14. The combination of claim 13 including a stop shoulder in said port to be engaged by the end of said pipe.

15. The combination of claim 13 including a threaded nipple threadably received in said port.

16. Spool apparatus for use in an underground well having casing, comprising a) a body sized for travel in the well casing, b) said body defining a well fluid flow duct having a downward facing entrance and a sidewardly facing exit, c) there being a lower connection for coupling the body to lower well pipe to pass fluid into the body via said entrance, and an upper connection for coupling the body to upper carrier structure used for raising and lowering the body in the well casing, d) and there being means to latch connect the body to the well casing in a position for well fluid delivery from the body via said exit, e) said lower connection including a threaded bore in said body, there being a stop shoulder in a recess, f) the stop shoulder protruding to overhang the lower well pipe upper end, g) and wherein said latch means includes a snap ring expansible laterally in a body groove and into a position to land on an upward facing surface on a sub, the ring engagable with a locking shoulder to deflect the ring generally radially for upward travel in the casing.

17. Spool apparatus for use in an underground well having casing, comprising a) a body sized for travel in the well casing, b) said body defining a well fluid flow duct having a downward facing entrance and a sidewardly facing exit, c) there being a lower connection for coupling the body to lower well pipe to pass fluid into the body via said entrance, and an upper connection for coupling the body to upper carrier structure used for raising and lowering the body in the well casing, d) said lower connection including a threaded tubular stem protruding downwardly from said body, e) and there being latch means that includes a snap ring positioned to disconnect the body from the well casing in response to upward displacement of said carrier structure, the snap ring being expansible laterally in a body groove and into a position to land on an upward facing surface on a sub, the ring defining a cam surface engagable with a locking shoulder to deflect the ring radially for upward travel in the casing.

18. Spool apparatus for use in an underground well having casing, comprising a) a body sized for travel in the well casing, b) said body defining a well fluid flow duct having a downward facing entrance and a sidewardly facing exit, c) there being a lower connection for coupling the body to lower well pipe to pass fluid into the body via said entrance, and an upper connection for coupling the body to upper carrier structure used for raising and lowering the body in the well casing, d) said lower connection including a threaded bore in said body, there being a stop shoulder in a recess in the body, to stop the upper end of the lower well pipe, the stop shoulder overhanging that upper end, e) there being latch means to connect the body to well casing, f) and wherein said latch means includes a snap ring expansible laterally in a body groove and into a position to land on an upward facing surface on a sub, the ring engagable with a locking shoulder to deflect the ring generally radially for upward travel in the casing.

19. Spool apparatus for use in an underground well having casing, comprising a) a body sized for travel in the well casing, b) said body defining a well fluid flow duct having a downward facing entrance and a sidewardly facing exit, c) there being a lower connection for coupling the body to lower well pipe to pass fluid into the body via said entrance, and an upper connection for coupling the body to upper carrier structure used for raising and lowering the body in the well casing, said lower connection including a threaded bore in said body, there being a stop shoulder in a recess in the body, to stop the upper end of the lower well pipe, the stop shoulder overhanging that upper end, d) said body including a port in registration with said exit, to align with the end of a sidewardly extending pipe that is received by a housing port defining a second stop shoulder to be engaged by said end of the pipe, e) there being latch means to connect the body well casing, f) and wherein said latch means includes a snap ring expansible laterally in a body groove and into a position to land on an upward facing surface on a sub, the ring engagable with a locking shoulder to deflect the ring generally radially for upward travel in the casing.

20. The combination of claim 19 wherein said second stop shoulder is axially spaced from the body exit.

21. The combination of claim 19 including a plastic nipple received in said housing port.

22. The combination of claim 19 wherein the lower connection includes a plastic tubular stem that extends downwardly from said body, and is integrally molded with said body.

23. Spool apparatus for use in an underground well having casing, comprising a) a body sized for travel in the well casing, b) said body defining a well fluid flow duct having a downward facing entrance and a sidewardly facing exit, c) there being a lower connection for coupling the body to lower well pipe to pass fluid into the body via said entrance, and an upper connection for coupling the body to upper carrier structure used for raising and lowering the body in the well casing, said lower connection including a threaded bore in said body, there being a stop shoulder in a recess in the body, to stop the upper end of the lower well pipe, the stop shoulder overhanging that upper end, d) said lower connection including a plastic tubular nipple that extends downwardly from said body, and has integrally molded connection with said body, e) there being latch means to connect the body to well casing, f) and wherein said latch means includes a snap ring expansible laterally in a body groove and into a position to land on an upward facing surface on a sub, the ring engagable with a locking shoulder to deflect the ring generally radially for upward travel in the casing.

24. Spool apparatus for use in an underground well having casing, comprising a) a body sized for travel in the well casing, b) said body defining a well fluid flow duct having a downward facing entrance and a sidewardly facing exit, c) there being a lower connection for coupling the body to lower well pipe to pass fluid into the body via said entrance, and an upper connection for coupling the body to upper carrier structure used for raising and lowering the body in the well casing, d) and there being latch means to connect the body to the well casing in a position for well fluid delivery from the body via said exit, and wherein said latch means includes a holder positioned to disconnect the body from the well casing in response to upward displacement of said carrier structure, the holder being expansible laterally in a body groove and into a position to land on an upward facing surface on a sub, the holder defining a cam surface engagable with a locking shoulder to deflect the holder laterally for upward travel in the casing, e) said lower connection including a threaded bore in said body, there being a stop shoulder in a body recess, said body and stop shoulder consisting of plastic material, f) the stop shoulder located at the base of female threads in the plastic body to receive upward compressive loading transmitted by the upward terminal of metallic well pipe having threaded interfit with said threaded bore, below the level of the stop shoulder, thereby to prevent excessive tightening of said interfit the threaded bore aligned with said upper connection.

25. Spool apparatus for use in an underground well having casing, comprising a) a body sized for travel in the well casing, b) said body defining a well fluid flow duct having a downward facing entrance and a sidewardly facing exit, c) there being a lower connection for coupling the body to lower well pipe to pass fluid into the body via said entrance, and an upper connection for coupling the body to upper carrier structure used for raising and lowering the body in the well casing, d) and there being means to connect the body to the well casing in a position for well fluid delivery from the body via said exit, and wherein said latch means includes a holder positioned to disconnect the body from the well casing in response to upward displacement of said carrier structure, the holder being expansible laterally in a body groove and into a position to land on an upward facing surface on a sub, the holder defining a cam surface engagable with a locking shoulder to deflect the holder laterally for upward travel in the casing, e) said lower connection including an externally threaded nipple integral with said body, said body and nipple consisting of plastic material, said nipple protruding downwardly, and in axial alignment with said upper connection, said nipple adapted for connection with lower well pipe below said body, with the lower end of the nipple in engagement with the lower well pipe to block excessive tightening of said nipple external threading.

* * * * *